US006440529B1

(12) United States Patent
Baumgart et al.

(10) Patent No.: US 6,440,529 B1
(45) Date of Patent: Aug. 27, 2002

(54) GRID STRUCTURE REINFORCEMENT FOR ROADS

(75) Inventors: Christoph Baumgart, Sprockhövel; Jöroen Klompmaker, Wuppertal, both of (DE)

(73) Assignee: Luckenhaus Technische Textilien GmbH & Co., Wuppertal (DE)

( * ) Notice: Subject to any disclaimer, the term of this patent is extended or adjusted under 35 U.S.C. 154(b) by 0 days.

(21) Appl. No.: 09/646,769

(22) PCT Filed: Mar. 11, 1999

(86) PCT No.: PCT/EP99/01581

§ 371 (c)(1),
(2), (4) Date: Sep. 22, 2000

(87) PCT Pub. No.: WO99/49136

PCT Pub. Date: Sep. 30, 1999

(30) Foreign Application Priority Data

Mar. 23, 1998 (DE) ..... 198 12 475

(51) Int. Cl.[7] ..... B32B 3/24; E01C 11/16

(52) U.S. Cl. ..... 428/137; 428/139; 428/140; 428/131; 428/489; 442/25; 442/26; 442/48; 442/57; 442/58; 404/134; 404/70

(58) Field of Search ..... 428/137, 139, 428/140, 131, 489; 404/134, 70; 442/25, 26, 48, 57, 58

(56) References Cited

U.S. PATENT DOCUMENTS

| | | | | | |
|---|---|---|---|---|---|
| 1,207,726 | A | * | 12/1916 | Eades | 442/48 |
| 2,115,667 | A | | 4/1938 | Ellis | 94/7 |
| 4,337,290 | A | * | 6/1982 | Kelly et al. | 156/222 |
| 4,680,213 | A | | 7/1987 | Fourezon | 428/105 |
| 4,834,577 | A | * | 5/1989 | Perfetti | 156/71 |
| 5,273,804 | A | * | 12/1993 | Brian et al. | 428/131 |
| 5,439,726 | A | * | 8/1995 | Woiceshyn | 428/109 |
| 5,616,395 | A | * | 4/1997 | Baravian et al. | 156/148 |
| 5,836,715 | A | * | 11/1998 | Hendrix et al. | 404/134 |
| 6,238,761 | B1 | * | 5/2001 | Jeong et al. | 156/291 |

FOREIGN PATENT DOCUMENTS

| | | | |
|---|---|---|---|
| DE | 3821785 | | 1/1990 |
| DE | 19543991 | | 5/1997 |
| FR | 2076016 | | 1/1971 |
| FR | 2710352 | | 3/1993 |
| FR | 271695 | A1 * | 8/1995 |

* cited by examiner

*Primary Examiner*—William P. Watkins, III
(74) *Attorney, Agent, or Firm*—Scott R. Foster; Pandiscio & Pandiscio

(57) ABSTRACT

This invention relates to a grid structure (1) for reinforcement in road building, with crossing strands of warp and woof. The openings of the grid are traversed by longitudinal-laminar belts of textile material, leaving free passage openings.

15 Claims, 2 Drawing Sheets

GRID STRUCTURE REINFORCEMENT FOR ROADS

Such a grid structure in the form of a grid fabric is disclosed by U.S. Pat. No. 2,115,667.

This grid fabric is used for the laminar reinforcement of road pavement. For this purpose, the grid fabric is laid on the foundation and covered with a bituminous asphalt coat. The grid consists of belts of fiberglass material and is therefore relatively rigid flexurally.

The road surface is then to be applied to the foundation prepared in this way, for example in the form of a coarse layer and a fine layer.

For the inlaid grid fabric not to be a hindrance when applying the road surface, it has to be held fast in the bituminous asphalt coat.

However, there are a number of parameters in this that can be optimally observed only with difficulty.

If the temperature of the asphalt coat is too high with appropriate thickness of the coat, there is a risk that the grid will sink in. The prestress inherent in the glass fibers can also lead to local lifting of the grid fabric out of the asphalt bed. If the temperature of the bituminous asphalt coat is too low, the grid floats. It may also happen that the retaining force of the asphalt coat on the grid fabric is too low.

In this case there is also a risk that the grid fabric will protrude from the asphalt bed.

To prevent this, it is also disclosed by DE 195 43 991 how to combine an appropriate grid fabric with a nonwoven fabric. This forms a grid fabric whose openings are filled fully with this nonwoven material.

This can indeed substantially increase the retaining forces of the bituminous asphalt coat on the grid fabric.

The penetration of the asphalt coat through the nonwoven layer, however, is very strongly dependent on time and temperature. For this reason there is a risk of the formation of cavities between the asphalt coat and the road surface.

This can be avoided only by another operating step, by applying an additional asphalt coat on the laid fabric-nonwoven fabric composite. This type of full-area composite also provides the capability of a water runoff barrier, which is advantageous in case of cracks in the road surface.

During the changeover from freezing to thawing periods, the penetration of water into the road foundation is substantially hindered. The water consequently runs off only to the side.

It is the purpose of this invention to provide a grid structure that keeps adhering until the road surface is applied, while avoiding additional operating steps and excluding defects in the asphalt coat.

The invention provides the benefit of a superproportional increasing of the retaining forces for the asphalt coat without loss of tensile strength of the interlaced strands of textile material.

This benefit is achieved by the fact that the invention integrates the basic concepts of the laminar bonding zone into the requirement of good penetration of the asphalt coat.

Because of the "only" partially permeable filling of the grid fabric, enough open places remain in the individual grid openings through which the liquid bituminous asphalt coat can penetrate from the bottom of the grid structure to the top of the grid structure.

The grid structure pursuant to the invention is thus enclosed form both sides by a previously applied layer of bituminous material immediately after being laid down, so that on the one hand the problems of inadequate penetration are avoided, and at the same time the retaining forces on the grid structure are increased considerably.

The thin textile material—from a microscopic viewpoint—forms individual material fibers that can be retained in the asphalt coat, so to speak, and in this way can provide for a practically laminar composite by intercalation into the asphalt coat.

The thin textile material should be of an absorbent nature and the grid openings should fill up leaving open points of passage somewhat uniformly distributed.

Materials that are rough, fibrous, interlacing, and interleaving are advantageous.

Therefore, special importance is ascribed to the interleaving effect.

Each of the many individual fibers of the textile material is inlaid in the asphalt coating by itself, and is bound on practically on all sides. Since there is an intimate bond between the strands of the grid structure and the longitudinal-laminar belts, which partly fill up the grid openings, the retaining forces produced in this way are transferred to their full extent to the strength components of the grid structure. The strength components of the grid structure are the individual strands that are gripped between the grid openings.

The starting material for the longitudinal-laminar belts can be twisted and untwisted threads, fiber and/or staple fiber rovings.

The thickness of the longitudinal laminar belts should not exceed the thickness of the strands of the grid if possible.

In this way, the grid structure is reliably prevented from floating even with a relatively thin asphalt coat.

To facilitate the penetration of the asphalt coat at the passage holes, the thickness of the belts should decrease slightly toward the edges of the belts.

In addition, the so-called capillary effect can also be utilized in this way, since the fiber thickness at the edges can be somewhat less than in the center of the laminar belt.

The microscopic cavity areas formed in this way at the edges favor the penetration of the asphalt coat.

If the edges of the belts are unraveled essentially irregularly, a statistically favorable distribution of retaining forces is produced inside the grid openings.

If the edges of adjacent belts then merge into one another/are connected to one another with mutual contact, the belts in addition also contribute to the stabilization of the grid structure and nevertheless permit the "flooding" of the reinforcing material with the asphalt material.

It is immaterial in principle whether the longitudinal-laminar belts run in the warp direction or in the woof direction of the grid structure of the grid fabric. When the belts run in the woof direction, the belts can also connect to the warp threads of each strand, e.g., they can be knitted, glass fiber/rovings composites, or interwoven. This leads to a lattice structure with stable design and high strength without impairing the strength of the individual strands. This also applies to belts that run in the warp direction.

An embodiment in which the laminar fraction of the belts amounts to more than 50% based on the area of the grid opening is advantageous.

Degrees of filling of about 10–90% meet the requirements of the invention.

The belts can be formed from thin parallel threads, thin ribbons, or a thin roving of fibers/staple fibers.

It is desirable according to the invention for the grid structure to be applied onto a polymer bitumen dispersion. This should have a softening point of about 90 degrees Celsius.

If this is a plastic with a polymer bitumen fraction, an intimate bond is produced between the coating and the bituminous asphalt coat on the road foundation from fusing together.

The polymer bitumen fraction supplies the ability to heat-seal the polymer bitumen dispersion and is practically equivalent to a two-part composite between the road substructure and the grid structure.

Suitable materials for the warp, woof, and belts are glass and polyester, as well as any other materials suitable for reinforcing grids.

Since the fractions of glass and polyester, for example, can each be between 0 and 100% by weight, it is recommended that the fractions of glass in each case be supplemented by the fraction by weight of polyester to make 100%.

BRIEF DESCRIPTION OF THE DRAWINGS

The invention will be explained in detail with reference to examples of embodiment. The Figures show.

DESCRIPTION OF THE PREFERRED EMBODIMENT

Figure 1:
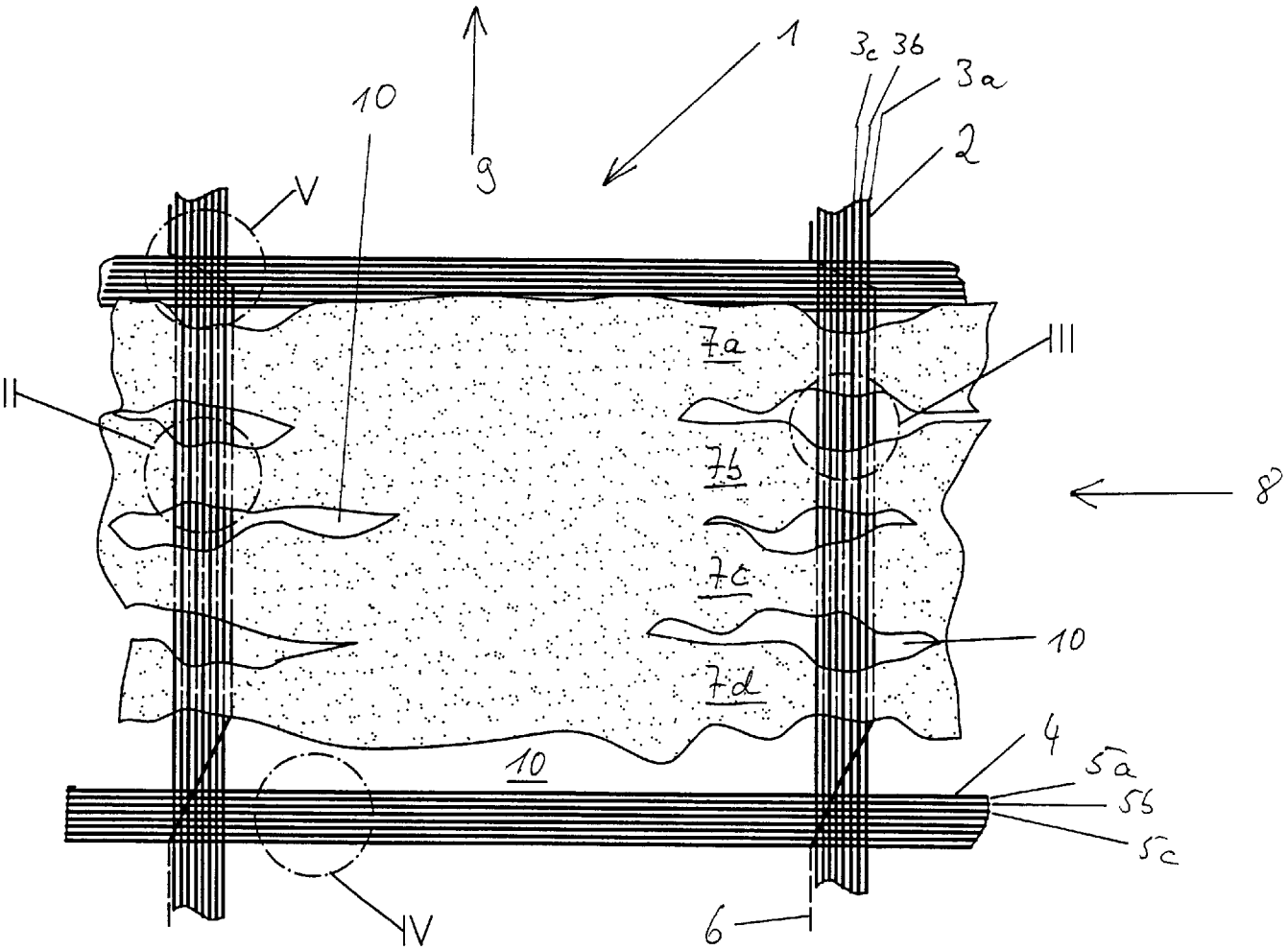
FIG. 1 first example of embodiment of the invention.

If not otherwise stated below, the following description applies to all of the Figures.

The Figures show a grid structure in the form of a grid fabric 1 as used for reinforcement in road building.

The grid fabric in this case consists of strands of warp threads 2 and woof threads 4 woven interwoven with one another.

The strand of warp threads 2 consists of a number of individual parallel warp threads 3*a* to 3*h*.

The strand of woof threads 4 consists of a number of likewise parallel woof threads 5*a* to 5*h*.

The individual warp threads and woof threads are strictly parallel to one another and form a solid strand bundle of little thickness. The individual warp threads and woof threads lie flat beside one another and are parallel directly against one another.

To give strength even now to the grid fabric produced, an encircling individual thread 6 is carried along in the warp direction 9 for each strand of warp threads 2, which runs from intersection to intersection, first over and then under the strand of warp threads 2, and binds the particular strand of woof threads to the strand of warp threads 2.

To do this, the encircling individual thread 6 also alternates sides of the strand of warp threads from intersection to intersection.

The warp threads and woof threads each consist of filaments of textile material, for example polyester filaments and/or glass filaments, with each of the materials present between 0 and 100% by weight and each adds to the other of the two materials to make up 100%.

Several strands of warp threads 2 and strands of woof threads 4 form a grid fabric that is already prestrengthened. Every two adjacent strands of warp threads 2 and two likewise adjacent strands of woof threads 4 enclose between them a grid opening, that has a length of about 1 to 10 cm on a side.

It is crucial for each of the grid openings to be filled up by a number of longitudinal-laminar belts of thin textile material while remaining partially permeable. The longitudinal-laminar belts have the reference symbols 7*a* to 7*d*.

Depending on the actual size of the grid opening, it may definitely also be sufficient to integrate only a single longitudinal-laminar belt into the grid fabric.

However, it is important for the filling material of the longitudinal-laminar belts to leave open so-called passage openings 10. The passage openings 10 are open places, so to speak, in the grid fabric 1 through which the previously applied asphalt coat can flow from the bottom to the top and the reverse. Because the filling of the grid openings is only partial, there remain a number of sufficiently large passage openings. The asphalt coat can thus bind the longitudinal-laminar belts from the bottom, and after penetration, it can flood it from the top only shortly after the grid fabric has been laid down on the asphalt coat.

Since this can happen essentially with no further action from the outside, the road pavement can be applied immediately after laying the grid structure in place.

If the thickness of the belts 7*a* to 7*d* is made practically as small as the thickness of the warp thread strands 2 and woof thread strands 4, a defect-free binding of the grid fabric in the road substructure can be produced with very little consumption of bituminous asphalt overlay.

The irregularly unraveled edges of the longitudinal-laminar belts 7*a* to 7*d* provide—statistically—a reliable guarantee of good distribution of the retaining forces from the asphalt coat to the grid fabric.

Since it is sufficient for the invention to leave open only up to about 30% of the area of the grid opening, the edges of adjacent belts can merge into one another with mutual contact.

The islands left open between the belts constitute sufficiently large passage openings in the sense of partial permeability.

Figure 2:
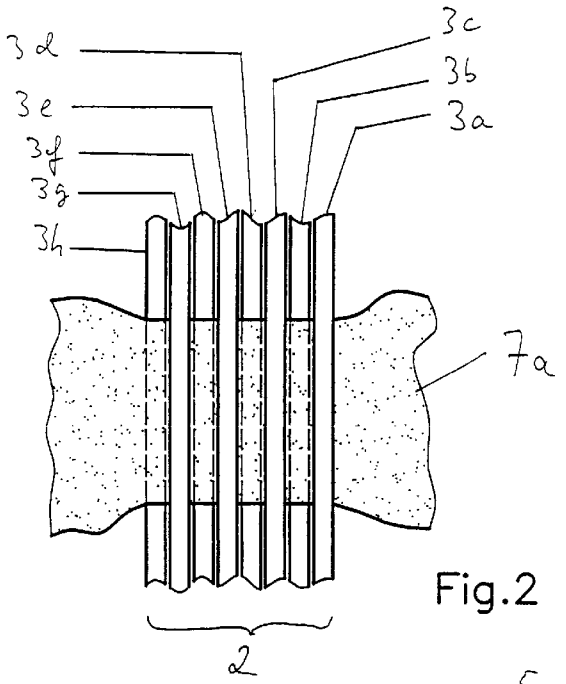
FIG. 2 a detailed view of the region II of FIG. 1.

FIG. 2 in particular shows an intersection between the warp thread strand 2 and one of the belts 7*a*.

Since the belt 7*a* in this case runs in the woof direction 8 of the grid fabric 1, it is possible to interweave the belts 7*a* to 7*d* with the warp threads 3*a* to 3*h*.

In addition, it is shown that the belt 7*a* is interwoven with each individual warp thread 3*a* to 3*h* from each individual warp thread strands 2.

Since each two adjacent warp threads run alternately on the top and the bottom of the belt 7*a*, a shift-proof binding of the belt 7*a* in the warp thread strand 2 thus occurs.

Figure 3:
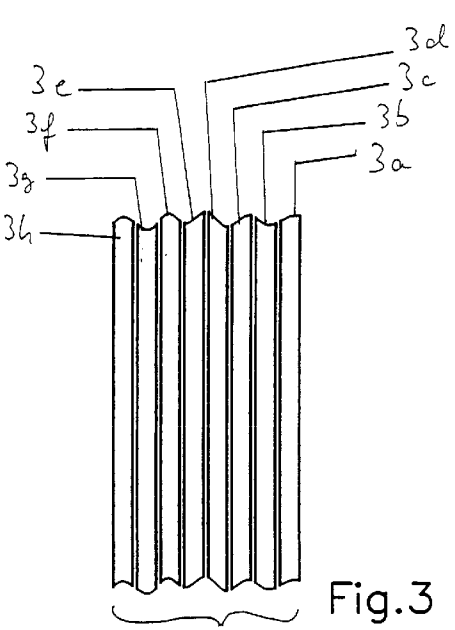
FIG. 3 a detailed view of the areas III of FIG. 1.

FIG. 3 shows additionally a non-interwoven position of the warp thread strand. It can be seen that the warp threads run practically parallel and directly next to one another.

Since a coating of a polymer bitumen dispersion is preferably applied to the grid fabric thus formed after the interweaving process, adequately high strength is produced also at the positions in the warp thread strand 2 and woof thread strand 4 not interwoven with the longitudinal-laminar belts 7.

Figure 4:
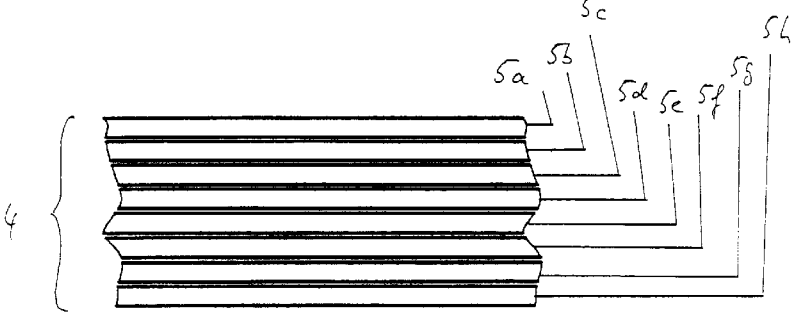
FIG. 4 a detailed view of the area IV of FIG. 1.

As FIG. 4 shows specifically, there are also regions in the woof thread strand 4 in which the woof threads are only exactly parallel and adjacent to one another and excellent strand strength is produced by the subsequently applied coating of polymer bitumen dispersion.

Figure 5:
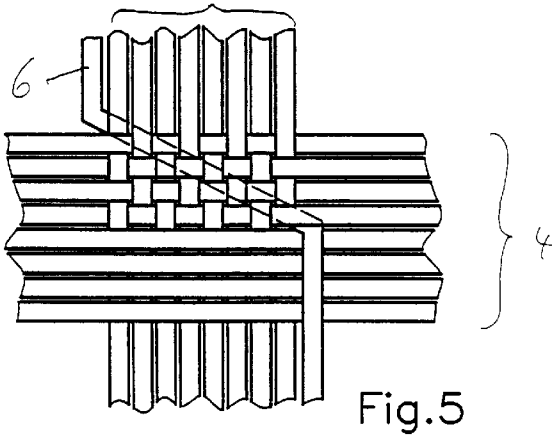
FIG. 5 a detailed view of the area V of FIG. 1.

In addition, FIG. 5 shows an intersection between warp thread strand 2 and woof thread strand 4. Half of the woof thread strand 4 is laid completely over the warp thread strand 2. This half is held by the encircling individual thread 6 that also runs in the warp direction 9.

Each of the individual threads of the other half of the woof thread strand is interwoven with an individual thread from the warp thread strand by itself.

Since the encircling individual thread 6 also alternates from the top to the bottom and at the same time from the right to the left side of the point of intersection, adequate strength is also obtained for the non-interwoven part of the woof thread strand at this intersection.

The longitudinal-laminar belts 7 can be made of thin parallel threads. In the same way, thin ribbons or thin fiber/staple fiber rovings are practical.

The use of fiber/staple fiber rovings provides the additional benefit of extensive unraveling of the belt edges, whereby the binding strength of the grid fabric in the underlaid asphalt coat is increased.

Grid structure in the present case means woven textiles, knitted fabrics, glass fiber/rovings composites, particularly glass fiber/rovings composites whose crossing strands 2, 4 are intermeshed with one another at the points of intersection with no interpenetration.

What is claimed is:

1. Grid structure (1) for reinforcement in road building, the grid structure comprising intersecting strands (2, 4) of textile material, each of said strands consisting of individual filaments (3*a–h*, 5*a–h*) that lie flat next to one another, wherein openings in the grid structure defined by said intersecting strands are traversed by longitudinal-laminar belts (7*a*–7*d*) of thin textile material partially covering the grid structure openings and leaving free passage portions of the openings (10).

2. Grid structure pursuant to claim 1, wherein thickness of the belts (7*a*–7*d*) is no greater than thickness of the strands (2, 4) and decreases towards edges of each belt (7*a*–7*d*).

3. Grid structure pursuant to claim 2, wherein the edges of the belts (7*a*–7*d*) are unraveled irregularly.

4. Grid structure pursuant to claim 3, wherein the edges of adjacent belts (7*a*, 7*b*; 7*b*, 7*c*; 7*c*, 7*d*) merge into one another.

5. Grid structure pursuant to claim 1, wherein the belts (7*a*–7*d*) run in at least one of a woof direction (8) and a warp direction (9) of the grid structure (1).

6. Grid structure pursuant to claim 5, wherein the belts (7*a*–7*d*) are connected to warp filaments (3*a*–h).

7. Grid structure pursuant to claim 6, wherein the belts (7*a*–7*d*) are connected to each warp filament (3*a*, 3*b*, 3*c*, 3*d*, 3*e*, 3*f*, 3*g*, 3*h*) of each warp thread strand (2).

8. Grid structure pursuant to claim 1, wherein an area of the grid structure openings covered by the belts is 10% to 90%.

9. Grid structure pursuant to claim 1, wherein the belts (7*a*–7*d*) are made of thin, parallel threads.

10. Grid structure pursuant to claim 1, wherein the belts (7*a*–7*d*) are made of thin ribbons.

11. Grid structure pursuant to claim 1, wherein the belts (7*a*–7*d*) are each made of a thin fiber/staple fiber roving.

12. Grid structure pursuant to claim 1, wherein the grid structure further comprises a coat of polymer bitumen dispersion applied thereon.

13. Grid structure pursuant to claim 12, wherein a softening point of the polymer bitumen dispersion is below about 180 degrees Celsius.

14. Grid structure pursuant to claim 6, wherein materials of the warp filaments, woof filaments, and belts contain at least one of glass and polyester.

15. Grid structure pursuant to claim 1, wherein the structure comprises a grid-like woven textile composite whose intersecting strands (2, 4) are intermeshed with one another at points of intersection without interpenetration.

* * * * *